US005592910A

United States Patent [19]

Suga et al.

[11] Patent Number: 5,592,910

[45] Date of Patent: Jan. 14, 1997

[54] CAMSHAFT PHASE CHANGING DEVICE

[75] Inventors: Seiji Suga; Hiroaki Imai; Katsuhiko Uchida, all of Atsugi, Japan

[73] Assignee: Unisia Jecs Corporation, Atsugi, Japan

[21] Appl. No.: 519,517

[22] Filed: Aug. 25, 1995

[30] Foreign Application Priority Data

Aug. 30, 1994 [JP] Japan ..... 6-204703

[51] Int. Cl.[6] ..... F01L 1/344

[52] U.S. Cl. ..... 123/90.17; 123/90.31

[58] Field of Search ..... 123/90.15, 90.17, 123/90.31; 74/567, 568 R; 464/1, 2, 160, 161

[56] References Cited

U.S. PATENT DOCUMENTS

| | | | |
|---|---|---|---|
| 4,811,698 | 3/1989 | Akasaka et al. | 123/90.17 |
| 5,033,327 | 7/1991 | Lichti et al. | 74/568 R |
| 5,088,456 | 2/1992 | Suga | 123/90.17 |
| 5,119,691 | 6/1992 | Lichti et al. | 74/568 R |
| 5,163,872 | 11/1992 | Niemiec et al. | 464/2 |
| 5,197,421 | 3/1993 | Hara | 123/90.17 |
| 5,203,290 | 4/1993 | Tsuruta et al. | 123/90.17 |
| 5,309,873 | 5/1994 | Suga et al. | 123/90.17 |
| 5,377,639 | 1/1995 | Nakadouzono et al. | 123/90.17 |

FOREIGN PATENT DOCUMENTS 6-28203 4/1994 Japan .

*Primary Examiner*—Weilun Lo
*Attorney, Agent, or Firm*—Foley & Lardner

[57] ABSTRACT

A camshaft phase changing device has a pair of axially-spaced annular front and rear gears disposed and engaged between co-axial drive and driven members. An annular piston is mounted to the annular rear gear by a plurality of piston pins. The piston pins pass through openings of the rear gear toward the front gear. Each of the openings is dimensioned to provide a clearance around the corresponding one of the piston pins and keep the rear gear out of contact with outer surface of the corresponding piston pin.

15 Claims, 7 Drawing Sheets

CAMSHAFT PHASE CHANGING DEVICE

BACKGROUND OF THE INVENTION

The present invention relates to a camshaft phase changing drive and more particularly to a camshaft phase changing device for varying the timing of the valve actuation by an engine driven camshaft.

Laid-open Japanese utility model application No. 6-28203 published on Apr. 15, 1994 discloses a variable camshaft phaser employing a pair of axially spaced annular gears disposed and engaged between co-axial drive and driven members. The drive member is in the form of a sprocket having an internal helical spline, while the driven member is in the form of a stub shaft, having an external helical spline, secured via a front cover to a camshaft by a screw. The pair of axially spaced annular gears, a front or outer gear and a rear or inner gear, have inner and outer splines engaging the external and internal helical splines. The front and rear gears are biased toward one another for lash take-up by a plurality of angularly spaced gear pins press-fitted in the rear gear and having head compressing coil springs. In order to axially move the front and rear gears in one direction to vary the phase relationship between the sprocket and stub shaft secured to the camshaft, an annular piston is disposed adjacent the inside face of the rear gear and mounted thereto by a plurality of angularly spaced piston pins. The piston pins are fixedly secured to the annular piston and extend forwardly through a plurality of openings, respectively, of the rear gear toward, for abutting engagement with, the inside face of the front gear. Snap rings are mounted around these pins, respectively, to limit axial and rearward displacement of the annular piston away from the rear gear. The annular piston carries an outer peripheral seal in sealing contact with a finished cylindrical inner surface of the sprocket and an inner peripheral seal in sealing contact with the opposed finished cylindrical surface of the stub shaft. The annular piston and its outer and inner peripheral seals cooperate with the inner cylindrical surface of the sprocket and the outer cylindrical surface of the stub shaft to define an annular chamber. The annular piston may be axially movable in one direction in response to oil supplied under pressure to the annular chamber. The annular chamber is disposed on one side of the annular piston adjacent the rear gear. A coil return spring extends between the annular piston and a rear flange of the stub shaft to urge the annular piston in a return direction compressing the annular chamber, i.e., a direction opposite to the one direction. Owing to this return spring, the piston pins are urged to abut on the inside face of the front gear. Return movement of the annular piston is initiated by discharging oil under pressure from the annular chamber. The passing of the piston pins through the rear gear to extend into abutting engagement with the front gear has a benefit. During stroke of the annular piston in the one direction, the front gear is pulled behind the rear gear. During return stroke of the annular piston, the rear gear is pulled behind the front gear. Thus, during each stroke of the annular piston, the separation of the front and rear gears from one another is increased slightly, reducing the lash take-up force, thus reducing the friction that opposes motion of the front and rear gears.

Such arrangements is shown in copending U.S. patent application Ser. No. 08/406,302 filed on Mar. 17, 1995 by Seiji TSURUTA and commoly assigned herewith. This U.S. patent application has corresponding applications in Korea and Germany, i.e., Korean Patent Application No. 95-5704 filed on Mar. 18, 1995 and German Patent Application No. 195 09 845.5 filed on Mar. 17, 1995.

In manufacturing variable camshaft phasers of the above kind, a very careful attention must be paid in finishing component parts and assembling them to keep alignment of an annular piston relative to the adjacent rear gear of a pair of annular gears to avoid undesired friction that opposes motion of piston pins relative to the rear gear.

During operation of the variable camshaft phaser of the above kind, the stub shaft is subject to alternating torque from the camshaft and this alternating torque is translated by helical spline connection into alternating thrust, causing the pair of annular gears and the sprocket to vibrate. Various measures have been taken to cope with this problem. According to a known measure, an O ring seal is operatively disposed between the front cover and the sprocket to apply an axial bias force to the sprocket to reduce noise inducted by collision between the sprocket and the associated parts. This axial force creates the friction that opposes angular motion of the sprocket relative to the front cover and the stub shaft. The magnitude of axial bias force depends primarily on load vs. defelction characteristic of the O ring seal and a distance between the bottom of a seal groove receiving the O ring seal and the adjacent front end of a forwardly extending hub of the sprocket. As is well known, the O ring seal provides a large rate of increase in load against a unit increase in deflection over a predetermined range of deflection. Thus, a strict control of this distance is needed in manufacturing the variable camshaft phasers of the above kind.

An object of the present invention is to improve a variable camshaft phaser of the above kind such that, with less strict alignment control, no undesired friction that opposes the motion of piston pins relative to a pair of annular gears is created.

SUMMARY OF THE INVENTION

According to the invention, there is provided a variable camshaft phaser for an internal combustion engine having a camshaft, comprising:

co-axial drive and driven members, said driven members being secured to the camshaft for rotation therewith about an axis;

a pair of axially-spaced annular gears disposed and engaged between said drive and driven members, said pair of axially-spaced annular gears having inner and outer splines;

means for biasing said annular gears for lash take-up;

force means for axially moving said annular gears in one direction to vary the phase relationship between said drive and driven members, said force means including an annular piston, a chamber on one side of said annular piston and oil supplied under pressure to said chamber, said annular piston being axially movable in said one direction in response to said oil under pressure supplied to said chamber, said annular piston having a plurality of pins that pass through a plurality of openings, respectively, of one of said annular gears;

return spring means biasing said annular piston in a return direction opposite to said one direction to move said the other of said annular gears in said return direction as said annular piston moves in said return direction, said plurality of pins having portions arranged to come into driving relation with said one of said annular gears for transmitting motion of said plurality of pins to said one of said annular gears to move said one of said annular gears in said one direction as said annular piston moves in said one direction, each of said plurality of openings of said one of said annular gears being so dimensioned as to provide a clearance around the corresponding one of said plurality of pins in such a manner as to keep said one of said annular gears out of contact with outer surface of said corresponding pin.

DETAILED DESCRIPTION OF THE INVENTION

Figure 1:
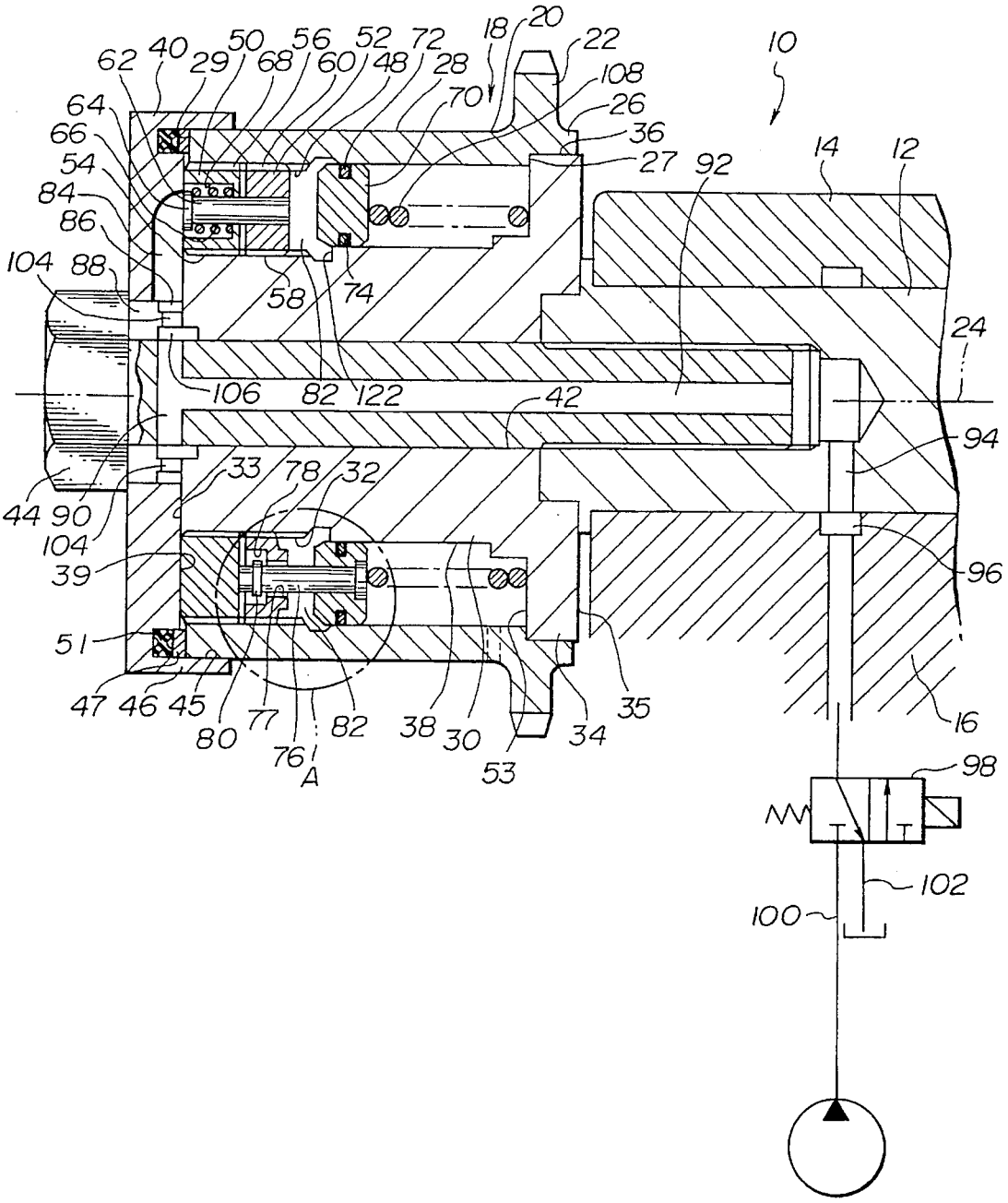
FIG. 1 is a section, in part, of a variable camshaft phaser in one or front extreme position with a solenoid control valve deenergized.

Referring to FIG. 1 of the drawings, in detail, numeral 10 generally indicates an internal combustion engine of the type having a camshaft 12 driven by a crankshaft, not shown. The camshaft 12 carries a plurality of cams (not shown) for actuating cylinder intake and/or exhaust valves (not shown) of the engine in a known manner. It is supported in part by a front bearing 14 that is carried by an engine cylinder head 16.

Figure 4:
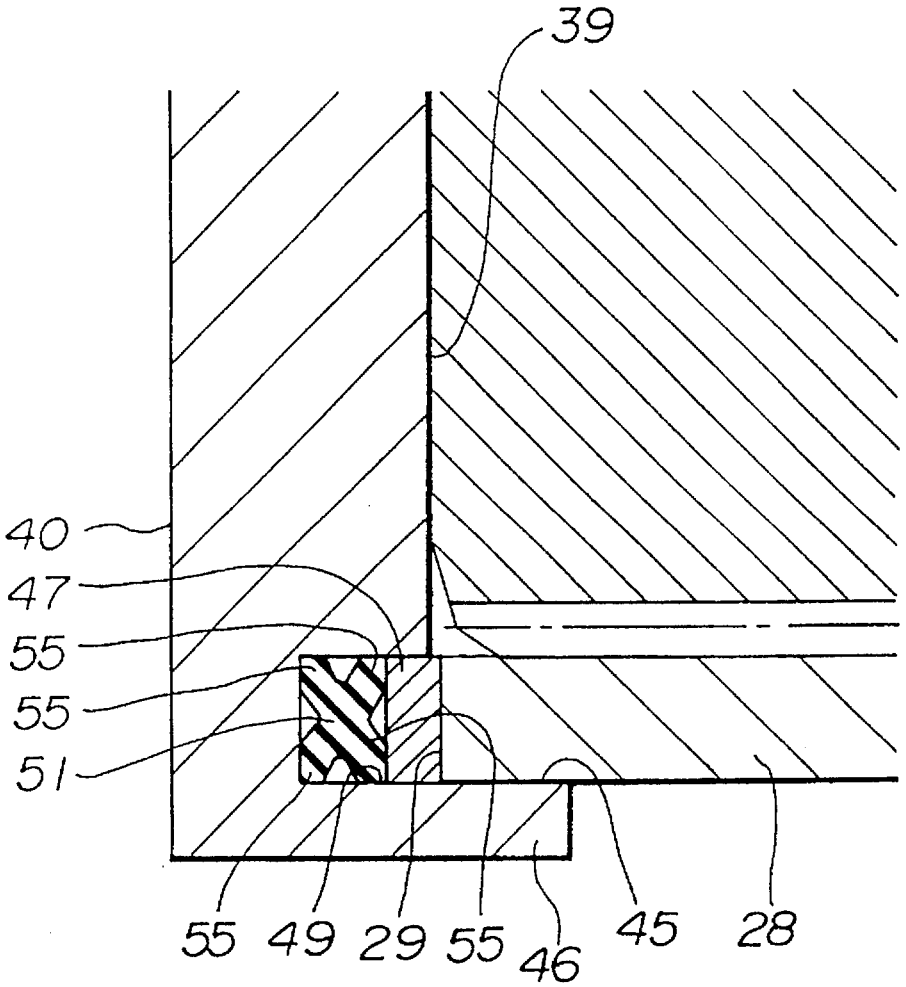
FIG. 4 is a fragmentary enlarged view of FIG. 1.

On the front, driven, end of the camshaft 12, there is a variable camshaft phaser 18 that includes a sprocket 20. The sprocket 20 comprises a wheel 22 that is toothed and is drivably engaged by a timing chain (not shown) for rotatably driving the sprocket 20 about an axis 24 that is co-axial with the camshaft 12. Within the wheel 22 are a rearwardly extending hub 26 and a forwardly extending hub 28. The rearwardly extending hub 26 is connected to the forwardly extending hub 28 to define an annular shoulder 27. As best seen in FIG. 4, the forwardly extending hub 28 has a front end 29.

The variable camshaft phaser 18 further includes a stub shaft in the form of a spline shaft 30 having an external helical spline 32 adjacent one or front end 33 and a rear flange 34 adjacent the other or rear end 35. The rear flange 34 has a finished journal 36 at its outer periphery. Between the external helical spline 32 and rear flange 34 is a finished cylindrical surface 38. The front end 33 of the spline shaft 30 abuts on an inner face 39 of a front cover 40. The cover 40 and spline shaft 30 are secured through a central opening 42 to the front end of the camshaft 12 by a screw 44.

The rearwardly extending hub 26 is carried for angular motion on the journal 36 of the rear flange 34. The forwardly extending hub 26 extends to the inner face 39 of the cover 40 and is carried for angular motion on a cylindrical inner surface 45 of a peripheral sleeve 46 of the cover 40. As best seen in FIG. 4, at the front end 29, the forwardly extending hub 28 abuts on a seal ring 47 partially projecting from an annular seal groove 49 under the bias of an elastic seal 51 within the seal groove 49. The seal groove 49 is formed by cutting the inner face 39 of the cover 40 inwardly along the cylindrical inner surface 46 of the peripheral sleeve 46. Thus, as best seen in FIG. 4, the seal ring 47 partially projects from the level of the inner face 39 of the cover 40, keeping the front end of the forwardly extending hub 28 of the sprocket 20 out of contact with the inner face 39 of the cover 40. The sprocket 20 is biased in an axial direction away from the cover 40 and toward the rear flange 34 of the spline shaft 30 due to the bias of the elastic seal 51, keeping the annular shoulder 27 in contact with a front face 53 of the rear flange 34, thus reducing noise owing to collision between the annular shoulder 27 and the front face 53 of the rear flange 34.

The bias force due to the elastic seal 51 creates the friction that opposes angular motion of the sprocket 20 relative to the cover 40 and the rear flange 34 of the spline shaft 30. The magnitude of this bias force depends primarily on load vs. deflection characteristic of the elastic seal 51 and a distance between the bottom of the seal groove 49 and the front end 29 of the forwardly extending hub 28 of the sprocket 20. As readily seen from FIG. 4, the elastic seal 51 is made of rubber and has a plurality of legs 55. This configuration provides a small rate of increase in load against a unit increase in deflection over a predetermined range of deflection, reducing product by product variability of the magnitude of bias force due to the elastic seal 51, thus reducing the product by product variability of the friction that opposes angular motion of the sprocket 20 relative to the cover 40 and the rear flange 34 of the spline shaft 30.

In this embodiment, the cross sectional profile of the elastic seal 51 is of the capital X. The cross sectional profile of the elastic seal 51 may be of the capital Y or may have four or more radial legs resembling the shape of a star.

The spline shaft 30, formed with the external helical spline 32 and cylindrical surface 38, extends forwardly within the forwardly extending hub 28 concentric with the inner diameter thereof. The forwardly extending hub 28 has an internal helical spline 48 facing the external helical spline 32 of the spline shaft 30. The facing splines 32 and 48 have opposite helix angles to provide for the phasing action.

Between and engaging both splines 32 and 48 are two axially-spaced annular gears, a front or outer gear 50 and a rear or inner gear 52, the rear gear 52 being closer to the rear flange 34 of the spline shaft 30. Both gears 50 and 52 have inner and outer helical splines drivingly mated with the external and internal splines 32 and 48 of the spline shaft 30 and sprocket 20, respectively. Specifically, the front gear 50 has inner and outer helical splines 54 and 56, while the rear gear 52 has inner and outer helical splines 58 and 60.

The front and rear gears 50 and 52 are biased toward one another by a plurality of angularly spaced pins 62 press-fitted in the rear gear 52 and having head 64 compressing coil springs 66 in recesses 68 on the far side or outside face of the front gear 50. The pins 62 extend through openings of the front gear 50. The openings are wide enough to allow the front gear 50 to move angularly relative to the rear gear 52. The splines of the front and rear gears 50, 52 are mis-aligned so that, when the front and rear gears 50 and 52 are urged toward one another, the splines of the front and rear gears 50 and 52 engage opposite sides of the mated splines 32 and 48 and thus take up the lash that would otherwise occur in transferring drive torque between the sprocket 20 and the spline shaft 30.

Figure 2:
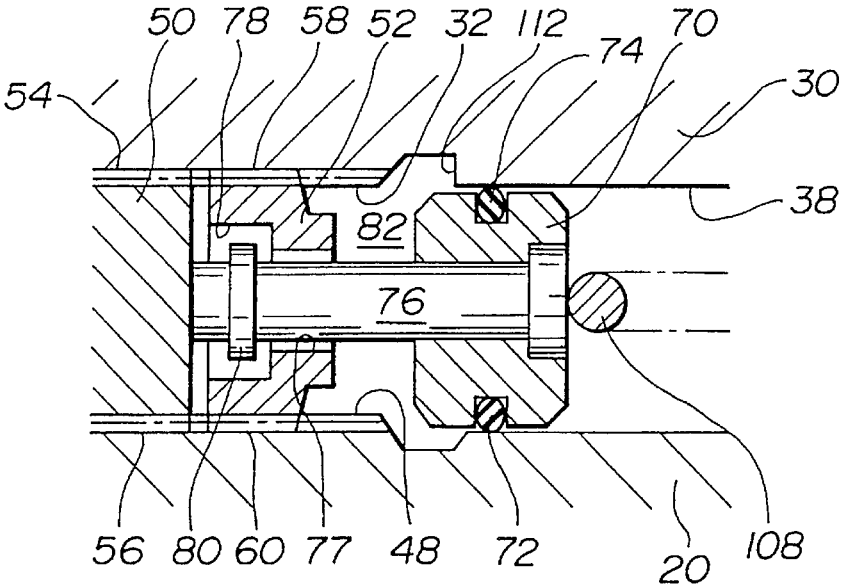
FIG. 2 is an enlarged fragmentary view of a circled portion A in FIG. 1.

Disposed between the cylindrical surface 38 of the spline shaft 30 and inner cylindrical surface of the forwardly extending hub 28 is an annular piston 70 carrying an outer peripheral seal 72 and an inner peripheral seal 74. The annular piston 70 is disposed adjacent the inside or rear face of the rear gear 52 and mounted thereto by a plurality of angularly spaced piston pins 76. The pins 76 are secured to the annular piston 70 and extend forwardly through openings 77 of the rear gear 52 toward, for abutting against, the inside or rear face of the front gear 50. As best seen in FIG. 2, the openings 77 of the rear gear 52 are wide enough to provide an ample clearance around the piston pins 76, and the rear gear 52 does not touch the outer surfaces of the piston pins 76, thus allowing mis-alignment of the annular piston 70 with the rear gear 52. Forward ends of the piston pins 76 are disposed within recesses 78 cut in the outside face of the rear gear 52. Snap rings 80 within the recesses 78 are mounted around or encircle the pins 76, respectively, and are engageable with the bottoms of the recesses 78 to limit axial and rearward displacement of the annular piston 70 away from the rear gear 52.

The annular piston 70 and seals 72, 74 cooperate with the cylindrical surface 38 of the spline shaft 30 and the adjacent cylindrical inner surface of the sprocket 20 to define an annular chamber 82. Oil under pressure may be supplied to or discharged from this annular chamber 82 through an oil passage 84 in the cover 40 that leads to an outer annular groove 86 in an end collar 88 of the spline shaft 30, radial and axial passages 90 and 92 in the screw 44, and a radial passage 94 in the camshaft 12 that leads to an annular groove 96. The annular groove 96 is connected through schematically-illustrated passage means with a solenoid control valve 98 that operates to supply oil from an oil gallery 100 or to drain oil to a discharge line 102 while blocking the flow from the gallery 100. The outer annular groove 86 in the end collar 88 is connected through a plurality of openings 104 to an inner annular groove 106 connected to the radial passage 90 in the screw 44.

The annular piston 70 is urged in a direction compressing the annular chamber 82 by a coil return spring 108 that extends between the annular piston 70 and rear flange 34 of the spline shaft 30. The return spring 108 urges the piston pins 76 to abut the inside or rear face of the front gear 50, urging the front gear 50 against the cover 40.

In operation of the variable camshaft phaser 18 embodiment just described, when the solenoid control valve 98 is not energized, (off condition), the control valve 98 closes off the gallery 100 and opens the annular chamber 82 to the discharge line 102. Thus, the return spring 108 is 30 able to maintain the annular piston 70, front and rear gears 50, 52 to their one or front extreme position near the cover 40 whereby the volume of the annular chamber 82 is held at a minimum. In this position, the front gear 50 is pressed against the inner face 39 of the front cover 40. In this position, the camshaft 12 may be maintained by the front and rear gears 50, 52 in a retarded phase relation with the sprocket 20 for operating of the actuated intake engine valves under desired retarded timing conditions.

When the engine operating conditions call for advanced valve timing of the intake engine valves, the solenoid valve 98 is energized to close off the discharge line 102 and to open the gallery 100 to supply oil under pressure to the annular chamber 82 in the variable camshaft phaser 18. The oil pressure moves the annular piston 70 against the bias of the return spring 108 to the extreme opposite position adjacent the rear flange 34, pulling the rear gear 52 after engagement of the snap rings 80 with the bottoms of the recesses 78 in the rear gear 52, then compressing the compression springs 66 to urge the front gear 50 to follow movement of the rear gear 52. When the solenoid valve 98 is energized (on condition), the rear gear 52 is pressed against an annular shoulder 112 defined between the external helical spline 32 and cylindrical surface 38 of the spline shaft 30. Thus, the front and rear gears 50, 52 can maintain the extreme opposite rearward or inner position whenever the solenoid valve 98 is energized. Because of the opposite helix angles of the external and internal helical splines 32 and 48, the rearward or inward motion of the front and rear gears 50, 52 vary the phase angle of the camshaft 12 relative to the sprocket 20 so that the timing of the associated engine valves is likewise varied.

A return to the retarded timing of the intake valves when called for is initiated by de-energizing the solenoid valve 98 blocking oil from the gallery 100 and allowing the annular chamber 82 in the variable camshaft phaser 18 to drain to the discharge line 102. The piston pins 76 extending from the annular piston 70 abut the front gear 50, pushing the front gear 50 with a force of the return spring 108 until the front and rear gears 50, 52 assume their extreme forward or outer position adjacent the cover 40 as illustrated in FIG. 1.

In addition to their phase-changing function, the front and rear gears 50, 52 are also means through which all torque is transferred from the sprocket 20 to the camshaft 12 and vice versa via their inner and outer splines 54, 58 and 56, 60 and the mating external and internal helical splines 32, 48. The annular piston 70 does not constitute the means for transferring the torque. The mis-alignment of the front and rear gears 50, 52 and their biasing toward one another by the pins 62 and springs 66 take up any clearance lash in the spline connections by urging the front and rear gears 50, 52 into engagement with opposite sides of the engaged splines 32, 48 as previously described.

The passing of the piston pins 76 through openings 77, in the rear gear 52, to extend into abutting engagement with the front gear 50 has a benefit. During the return stroke from on condition to off condition (see FIG. 1), the pulling of the rear gear 52 behind the front gear 50 as it is moved by the return spring 108 tends to increase slightly the separation of the front and rear gears 50, 52 from one another and thereby reduce the lash take-up force, thus reducing the friction that opposes the return motion of the front and rear gears 50, 52. The required force for the return stroke may thereby be reduced.

The snap rings 80 on the piston pins 76 are out of engagement with the bottom of the recesses 78 in the rear gear 52 during the return stroke, but they come into engagement with the bottom of the recesses 78 in the rear gear 52 to establish a drive connection from the piston pins 76 to the rear gear 52 during the stroke from off condition (see FIG. 1) to on condition. During this stroke from off condition to on condition, the pulling of the front gear 50 behind the rear gear 52 as it is moved by the annular piston 70 tends to increase slightly the separation of the front and rear gears 50, 52 from one another and thereby reduce the lash take-up force, thus reducing the friction that opposes the rearward motion of the front and rear gears 50, 52. The required force by the oil pressure may thereby be reduced.

Figure 3:
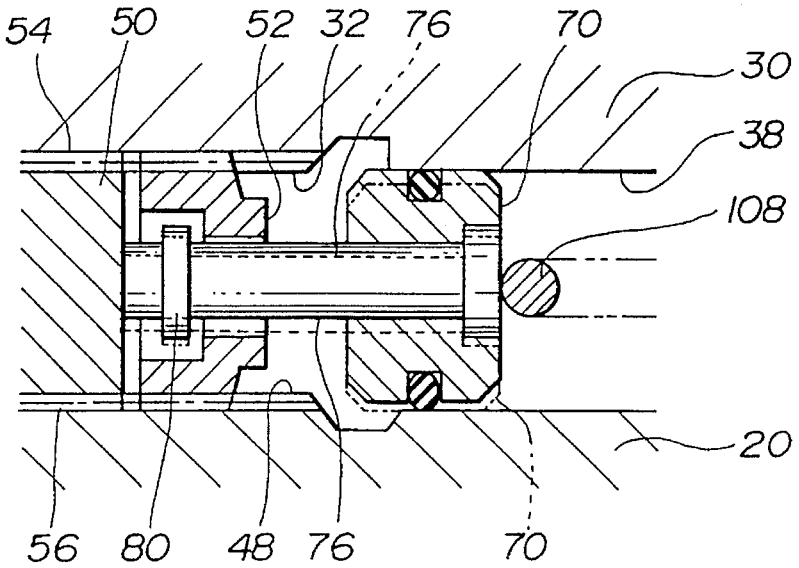
FIG. 3 is a view similar to FIG. 2.

FIG. 3 illustrates in the fully drawn line the annular piston 70 producing eccentricity in one direction relative to the rear gear 52 due to mis-alignment, and in dotted line the annular piston 70 producing the eccentricity in the opposite direction due to mis-alignment. Owing to the provision of the clearance around each of the piston pins 76, the rear gear 52 is kept out of contact with the outer surface of each of the piston pins 76 upon occurrence of mis-alignment of the annular piston 70 relative to the rear gear 52, thus eliminating the friction, between the rear gear 52 and the piston pins 75, that opposes smooth relative motion between the rear gear 52 and the piston 70.

Figure 5:
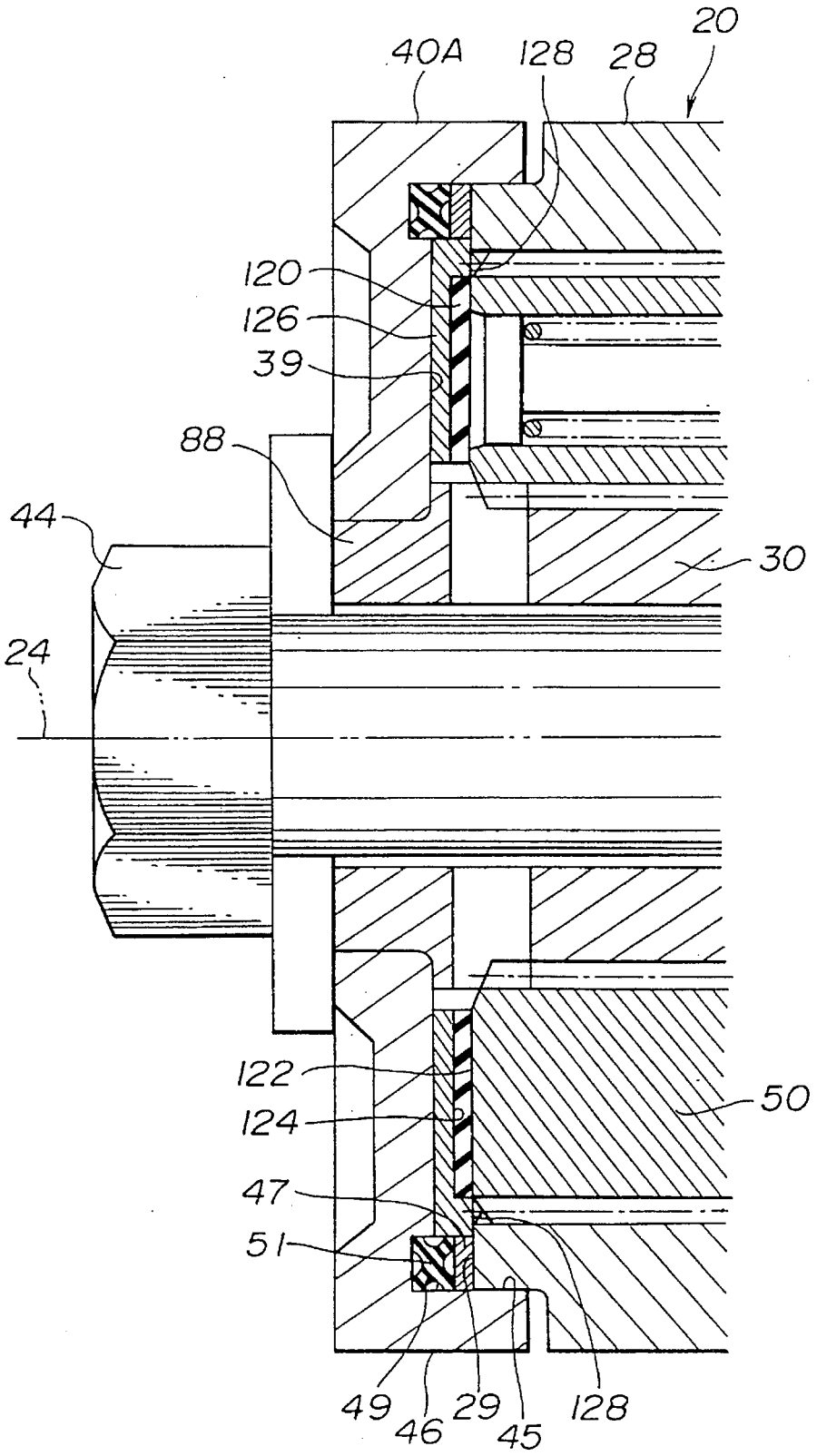
FIG. 5 is an enlarged fragmentary section of a modification of the variable camshaft phaser employing a cushion.

FIG. 5 illustrates a modified front cover 40A fixed to the spline shaft 30 for rotation therewith by means of a screw 44. The modified cover 40A is substantially the same as the cover 40 shown in FIG. 1 so that the same reference numerals as used in FIG. 1 are used to designate like or similar portions and parts. As different from the cover 40, the modified cover 40A carries a cushion 120 arranged to contact with a front or outside face 122 of a front annular gear 50. The cushion 120, made of elastic material such as rubber, is in the form of an annular disc and fixedly received in a central recess 124 of an annular disc-like cushion retainer 126. The cushion retainer 126 is fixedly attached to an inner face 39 of the cover 40A with its periphery spaced from cylindrical inner surface 45 of a peripheral sleeve 46 of the cover 40A to define a part of an annular seal groove 49. The cushion retainer 120 has a flat inner face 128 between the periphery thereof and the central recess 124 thereof. This inner face 128 slidably contacts with a front end 29 of a forwardly extending hub 28 to permit angular motion of a sprocket 20 about an axis 24 relative to the cover 40A. The arrangement is such that the inner face does not touch the front face 122 of the front gear 50 but the front end 29 of the forwardly extending hub 28, and the cushion 120 is opposed to the front face 122 of the front gear 50.

The provision of the cushion 120 prevents collision between the front face 122 of the front gear 50 and the inner face 39 of the cover 40A. The inner face 128 of the cushion retainer 126 keeps the cushion 120 out of contact with the front end 29 of the forwardly extending hub 28 of the sprocket 20 and bears stress during angular motion of the sprocket 20 relative to the cover 40A. Thus, the cushion 120 does not wear out quickly.

Figure 6:
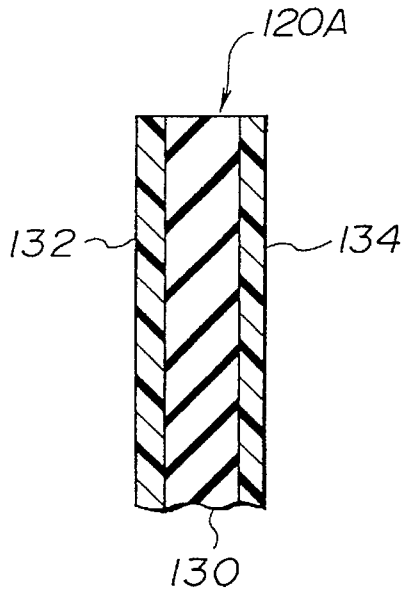
FIG. 6 is a fragmentary view of an alternative form of a cushion.
Figure 7:
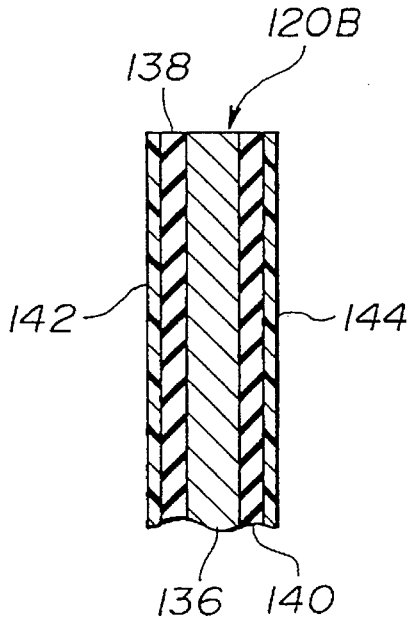
FIG. 7 is a view similar to FIG. 6, showing another alternative form of a cushion.

FIGS. 6 and 7 show construction of two alternative cushions 120A and 120B.

In FIG. 6, the cushion 122A includes an annular disc 130 made of elastic material such as rubber. The annular disc 130 has front and rear faces covered by outer layers 132 and 134 made of synthetic resin, respectively.

In FIG. 7, the cushion 120B includes an annular disc 136 made of inelastic material such as metal. This inelastic annular disc 136 has front and rear faces covered by elastic layers 138 and 140 of rubber, respectively, which are in turn covered by outer layers 142 and 144 of synthetic resin, respectively.

In the embodiment shown in FIGS. 1 to 4, the plurality of piston pins 76 of the annular piston 70 pass through the plurality of openings 77, respectively, of the rear gear 52 of the pair of axially-spaced annular gears 50, 52 and have portions, i.e., snap rings 80, arranged to come into driving relation with the rear gear 52 for transmitting motion of the plurality of piston pins 76 to the rear gear 52 to move the rear gear 52 as the annular piston 70 moves in one direction in response to oil supplied under pressure to the annular chamber 82. The other annular gear, i.e., the front gear 50, is disposed adjacent the far side of the rear gear 52 from the annular piston 70 and is biased toward the rear gear 52 for lash take-up by means of the associated compression springs 66 around the pins 62. The plurality of piston pins 76 extend toward the front gear 50 after passing through the rear gear 52 and kept in abutting contact with the inside face of the front gear 50 under the bias of the return spring 108 to move the front gear 50 as the annular piston 70 moves in the return direction opposite to the one direction.

If desired, an annular piston may be disposed between a front cover and a pair of axially-spaced annular gears. In this case, a plurality of piston pins pass through a plurality of openings of a rear gear of the pair of annular gears and have portions arranged to come into driving relation with the rear gear for transmitting motion of the plurality of piston pins to the rear gear to move the rear gear in one direction in response to oil supplied under pressure to an annular chamber. The other annular gear, i.e., a front gear, is disposed between the annular piston and the rear gear and biased away from the rear gear for lash take-up by means of a plurality of compression springs disposed between the front and rear gears. The plurality of piston pins pass through a plurality of openings, respectively, of the front gear. The annular piston has a pressure acting face adjacent the front gear and kept in abutting contact with the outside or front face of the front gear to move the front gear under the bias of a return spring as the annular piston moves in a return direction opposite to the one direction.

Figure 8:
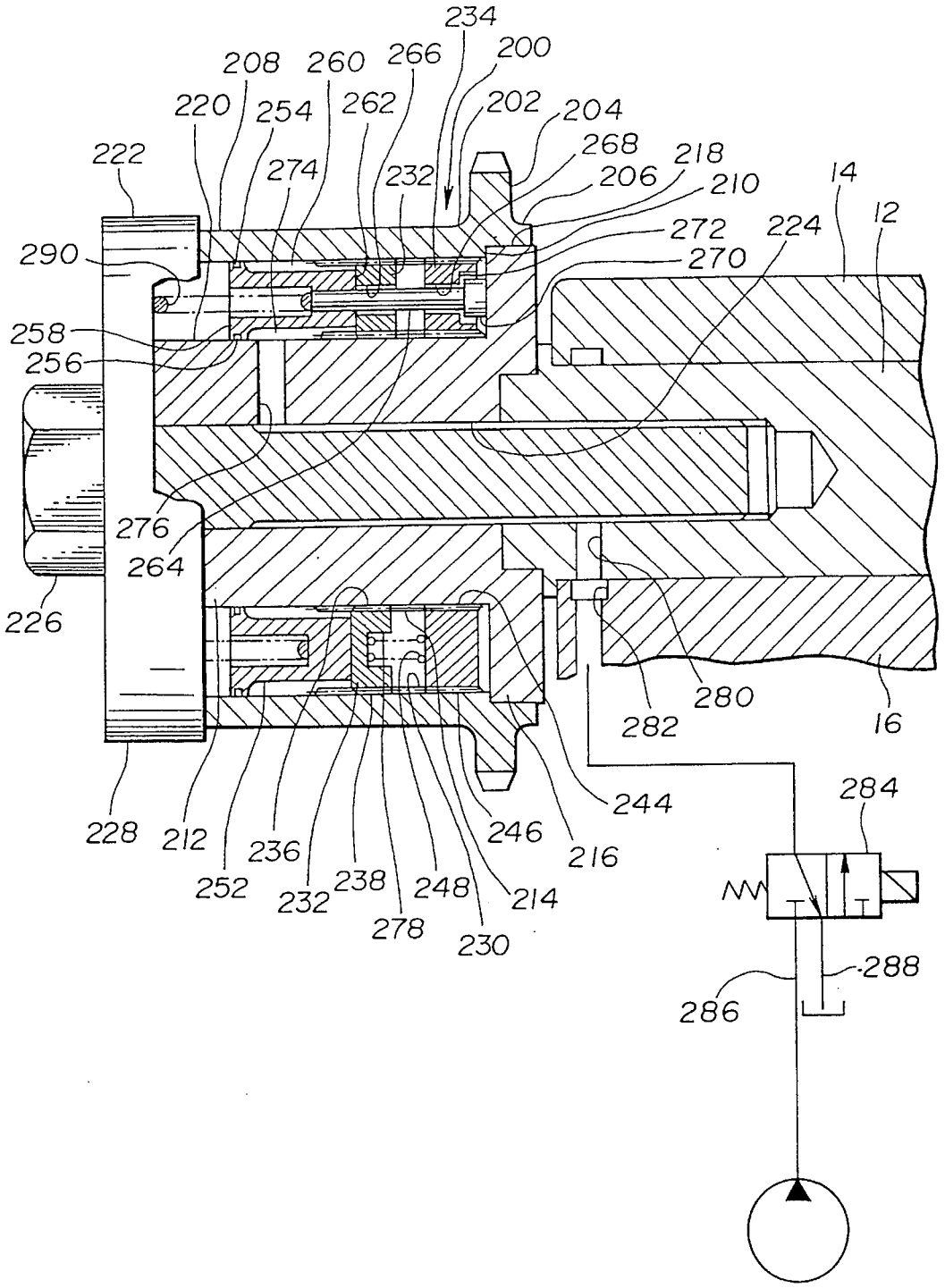
FIG. 8 is a view similar to FIG. 1 showing another embodiment of a variable camshaft phaser in one or rear extreme position with a solenoid control valve deenergized.
Figure 9:
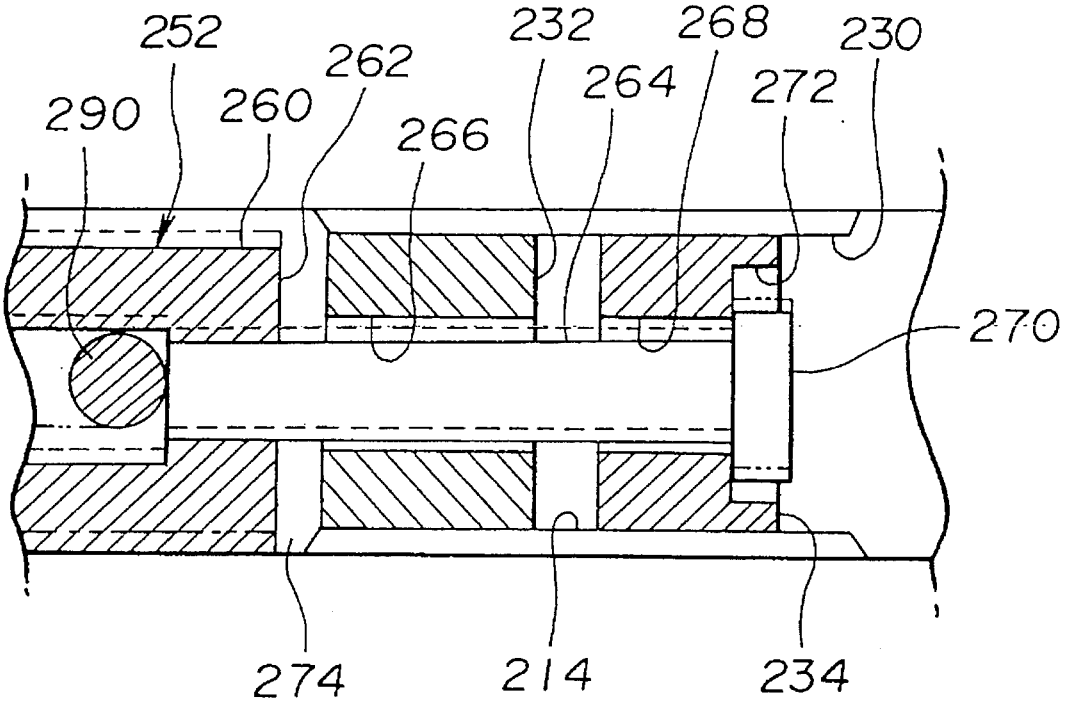
FIG. 9 is an enlarged fragmentary view of a portion of FIG. 8, but showing the parts in the other or front extreme position when the solenoid control valve is energized.

This piston arrangement is employed in another embodiment shown in FIGS. 8 and 9.

Referring to FIG. 8, a camshaft 12 is supported in part by a front bearing 14 carried by an engine cylinder head 16 of an internal combustion engine in the same manner as in FIG. 1. On the front end of the camshaft 12, there is a variable camshaft phaser 200 that includes a sprocket 202. The sprocket 202 comprises a toothed wheel 204 drivably engaged by a timing chain (not shown), for rotatably driving the sprocket 202. Within the wheel 204 are a rearwardly extending hub 206 and a forwardly extending hub 208. The rearwardly extending hub 206 is connected to the forwardly extending hub 208 to define an annular shoulder 210.

The variable camshaft phaser 200 further includes a stub shaft in the form of a spline shaft 212 having an external helical spline 214 adjacent a rear flange 216 thereof. The rear flange 216 has a finished journal 218 at its outer periphery. Between the external helical spline 214 and a front end of the spline shaft 212 is a finished cylindrical surface 220. Although not shown, the front end of spline shaft 212 abuts an inner face of a front cover 222 in the same manner as the front end 33 of the spline shaft 30 abuts the inner face 39 of the front cover 40 (see FIG. 1). The cover 222 and spline shaft 212 are secured through a central opening 224 to the front end of the camshaft 12 by a screw 226.

The rearwardly extending hub 206 is carried for angular motion on the journal 218 of the rear flange 216. The forwardly extending hub 208 extends to the inner face of the cover 222 and is carried for angular motion on a cylindrical inner surface of a peripheral sleeve 228 of the cover 222 in the same manner as the forwardly extending hub 26 is carried for angular motion on the cylindrical inner surface 45 of the peripheral sleeve 46 of the cover 40 (see FIG. 1).

The spline shaft 212 extends forwardly within the forwardly extending hub 208 concentric with the inner diameter thereof. The forwardly extending hub 208 has an internal helical spline 230 facing the external helical spline 214 of the spline shaft 212.

Between and engaging both splines 214 and 230 are two axially-spaced annular gears, called for convenience, a front gear 232 and a rear gear 234, the rear gear 234 being closest to the rear flange 216 of the spline shaft 212. The front and rear gears 232 and 234 have inner and outer helical splines drivingly mated with the external and internal splines 214 and 230, respectively. Specifically, the front gear 232 has inner and outer helical splines 236 and 238, while the rear gear 234 has inner and outer helical splines 244 and 246.

A plurality of coil springs 248 are mounted in recesses 250 on the inside or rear face of the front gear 232 and compressed between the front and rear gears 232 and 234 to bias one away from another. The splines of the front and rear gears 232, 234 are mis-alinged so that, when the front and rear gears 232 and 234 are urged from one another, the splines of the front and rear gears 232 and 234 engage opposite sides of the mated splines 214 and 230 and thus take up the lash that would otherwise occur in transferring drive torque between the sprocket 202 and spline shaft 212.

Between the cylindrical surface 220 of the spline shaft 212 and inner cylindrical surface of the forwardly extending hub 208 is an annular piston 252 carrying an outer peripheral seal 254 and an inner peripheral seal 256 at an annular disc portion 258. The annular piston 252 is disposed between the cover 222 and the pair of annular gears 50 and 52 and has a sleeve portion 260 extending from the disc portion 258 towards the front gear 232. The sleeve portion 260 of the annular piston 252 has an inside or rear face 262 for abutting engagement with the outside or front face of the front gear 232. The sleeve portion 260 has an outer peripheral surface spaced from the inner cylindrical surface of the forwardly extending hub 208 of the sprocket 202, and an inner peripheral surface spaced from the cylindrical surface 220 of 20 the spline shaft 212.

The annular piston 252 is mounted to the rear gear 234 by a plurality of angularly spaced piston pins 264. The piston pins 264 are secured to the sleeve portion 260 of the annular piston 252 and extend rearwardly through openings 266 of the front gear 232 and through openings 268 of the rear 234. The openings 266 of the front gear 266 and the openings 268 of the rear gear 234 are wide enough to provide an ample clearance around the piston pins 264, and the front and rear gears 232 and 234 do not touch the outer surfaces of the piston pins 264, thus allowing mis-alignment of the annular piston 252 with the front and rear gears 232 and 234. FIG. 9 shows, by the fully drawn line, the mis-alignment of the annular piston 252 with the front and rear gear 232 and 234. In FIG. 9, the dotted line shows the annular piston in alignment and concentric with the front and rear gears 232 and 234. Rearward heads 270 of the piston pins 264 are disposed within recesses 272 cut in the inside or rear face of the rear gear 234 and engageable with the bottoms of the recesses 272 to limit axial and forward displacement of the annular piston 252 away from the front gear 232.

The annular disc portion 258 of the annular piston 252, seals 254, 256 and the sleeve portion 260 of the annular piston 252 cooperate with the cylindrical surface 220 of the spline shaft 212 and the cylindrical inner surface of the forwardly extending hub 208 of the sprocket 202 to define an annular chamber 274. Oil under pressure may be supplied to or discharged from this annular chamber 274 through a radial passage 276 through the spline shaft 212, a passage 278 defined by the screw 226 within the central opening 224, and a radial passage 280 that leads to an annular groove 282. The annular groove 282 is connected through schematically-illustrated passage means with a solenoid control valve 284 that operates to supply oil from an oil gallery 286 or to drain oil to a discharge line 288 while blocking the flow from the gallery 286.

The annular piston 252 is urged in a direction compressing the annular chamber 274 by a coil return spring 290 that extends between the cover 222 and the annular piston 252. The return spring 290 urges the sleeve portion 260 of the annular piston 252 to abut the outside or front face of the front gear 232, urging the front gear 232 towards the rear flange 216.

In operation of the variable camshaft phaser 200, when the solenoid control valve 284 is not energized, the control valve 284 closes off the gallery 286 and opens the annular chamber 274 to the discharge line 288. Thus, the return spring 290 is able to maintain the annular piston 252, front and rear gears 232, 234 to their extreme rearward or inner position near the rear flange 216. In this position, the heads 270 of the piston pins 264 are pressed against the rear flange 216.

When it is energized, the solenoid valve 284 closes off the discharge line 288 and opens the gallery 286 to supply oil under pressure to the annular chamber 274. The oil pressure moves the annular piston 252 against the bias of the return spring 290 to the extreme opposite forward or outer position adjacent the cover 222, pulling the rear gear 234 after engagement of the heads 270 with the bottoms of the recesses 272 in the rear gear 234, compressing the springs 248 to urge the front gear 232 to follow the movement of the rear gear 234 (see FIG. 9). Thus, the front and rear gears 232 and 234 can maintain the extreme opposite forward or outer position whenever the solenoid valve 284 is energized.

A return to the extreme rearward or inner position is initiated by de-energizing the solenoid valve 284 blocking oil from the gallery 286 and allowing the annular chamber 274 to drain to the discharge line 288. The sleeve portion 260 of the annular piston 252 abuts the front face of the front gear 232, pushing the front gear 232 with a force of the return spring 290 until the front and rear gears 232 and 234 assume their extreme rearwawd or inner position as illustrated in FIG. 8.

What is claimed is:

1. A variable camshaft phaser for an internal combustion engine having a camshaft, comprising:

co-axial drive and driven members, said driven member being secured to the camshaft for rotation therewith about an axis;

a pair of axially-spaced annular gears disposed and engaged between said drive and driven members, said pair of axially-spaced annular gears having inner and outer splines;

means for biasing said annular gears one toward the other for lash take-up;

force means for axially moving said annular gears in one direction to vary the phase relationship between said drive and driven members, said force means including an annular piston, a chamber on one side of said annular piston and oil supplied under pressure to said chamber, said annular piston being axially movable in said one direction in response to said oil supplied under pressure to said chamber, said annular piston having a plurality of pins that passes through a plurality of openings, respectively, in one of said annular gears toward the other of said annular gears;

return spring means biasing said annular piston in a return direction opposite to said one direction to keep said plurality of pins in driving contact with the other of said annular gears to move said other of said annular gears in said return direction as said annular piston moves in said return direction, said plurality of pins having portions arranged to come into driving relation with said one of said annular gears for transmitting motion of said plurality of pins to said one of said annular gears to move said one of said annular gears in said one direction as said annular piston moves in said one direction, each of said plurality of openings of said one of said annular gears being dimensioned to provide a clearance around the corresponding one of said plurality of pins to keep said one of said annular gears out of contact with an outer surface of the corresponding pin.

2. A variable camshaft phaser as claimed in claim 1, wherein said driven members include a stub shaft having an external helical spline adjacent one end thereof and a flange adjacent the opposite end thereof, a cover adjacent said one end of said stub shaft and a screw arranged to secure said cover and said stub shaft to the camshaft for rotation therewith, said flange having a finished journal at an outer periphery thereof, said cover having a peripheral sleeve with a cylindrical inner surface.

3. A variable camshaft phaser as claimed in claim 2, wherein said drive members include a sprocket comprising a first hub and a second hub connected to said first hub to define an annular shoulder.

4. A variable camshaft phaser as claimed in claim 3, wherein said second hub is carried for angular motion on said journal of said flange of said stub shaft, and said first hub is carried for angular motion on said cylindrical inner surface of said peripheral sleeve of said cover.

5. A variable camshaft phaser as claimed in claim 4, wherein said cover is provided with a seal groove receiving therein an elastic seal and a seal ring in contact with said first hub to bias said sprocket toward said flange to keep said shoulder in contact with said flange.

6. A variable camshaft phaser as claimed in claim 5, wherein said elastic seal has a plurality of legs.

7. A variable camshaft phaser as claimed in claim 6, wherein said elastic seal has an X-shaped cross-sectional profile.

8. A variable camshaft phaser as claimed in claim 6, wherein said elastic seal has a cross-sectional profile with at least four legs.

9. A variable camshaft phaser as claimed in claim 5, wherein said cover carries a cushion arranged to contact with said other of said annular gears.

10. A variable camshaft phaser as claimed in claim 9, wherein said cover has fixedly attached thereto a cushion retainer having a central recess fixedly receiving therein said cushion.

11. A variable camshaft phaser as claimed in claim 10, wherein said cushion retainer has a periphery spaced from said cylindrical inner surface of said peripheral sleeve of said cover to define a part of said seal groove.

12. A variable camshaft phaser as claimed in claim 11, wherein said cushion retainer has a flat face between said periphery thereof and said central recess thereof, said flat face of said cushion retainer slidably contacts said first hub of said sprocket for allowing angular motion of said sprocket relative to said cover.

13. A variable camshaft phaser as claimed in claim 12, wherein said cushion is made of rubber.

14. A variable camshaft phaser as claimed in claim 12, wherein said cushion includes an elastic annular disc having one and opposite faces covered by outer layers made of synthetic resin, respectively.

15. A variable camshaft phaser as claimed in claim 12, wherein said cushion includes an inelastic annular disc having one and opposite faces covered by elastic layers of rubber, respectively, which are in turn covered by outer layers of synthetic resin, respectively.

* * * * *